US007681351B2

(12) United States Patent
Bucholtz et al.

(10) Patent No.: US 7,681,351 B2
(45) Date of Patent: Mar. 23, 2010

(54) HYDRAULIC RECOIL BUFFER ASSEMBLY

(75) Inventors: Brian C. Bucholtz, Lakeview, NY (US); William W. Shurmatz, Lancaster, NY (US); Gregg F. Johannes, Long Beach, CA (US)

(73) Assignee: Enidine, Inc., Orchard Park, NY (US)

( * ) Notice: Subject to any disclaimer, the term of this patent is extended or adjusted under 35 U.S.C. 154(b) by 471 days.

(21) Appl. No.: 11/599,693

(22) Filed: Nov. 15, 2006

(65) Prior Publication Data

US 2008/0110074 A1 May 15, 2008

(51) Int. Cl.
*F41C 23/06* (2006.01)
*F41A 3/94* (2006.01)

(52) U.S. Cl. ..... 42/1.06; 89/198

(58) Field of Classification Search ..... 42/1.06, 42/74; 89/198, 14.3, 42.01, 43.01
See application file for complete search history.

(56) References Cited

U.S. PATENT DOCUMENTS 3,001,312 A * 9/1961 Campbell ..... 42/74
3,233,354 A 2/1966 Ahearn
3,348,328 A 10/1967 Roy (Continued)

OTHER PUBLICATIONS

Remington 870/Mossberg 500 Tactical Stock Shox, 2 pgs.

(Continued)

*Primary Examiner*—Bret Hayes
(74) *Attorney, Agent, or Firm*—Hiscock & Barclay, LLP

(57) ABSTRACT

A hydraulic recoil buffer assembly for a firearm having a receiver and a fixed or collapsible stock assembly including an end cylinder adapted to be secured to the pistol grip or receiver of the firearm and slidably translatable with respect to the extension tube, and a hydraulic shock absorption assembly operative to produce a hydraulic resistance to a rearward movement of the end cylinder during recoil of the firearm. The hydraulic shock absorption assembly has an orifice restricted fluid flow passage and a piston head that compresses a return spring as the end cylinder moves rearward against a recoil coil spring. The recoil buffer assembly stores a portion of the recoil energy through compression of the recoil spring and the return spring, and dissipates a portion of the recoil energy through the resistance provided by fluid flow through the orifice restricted flow passage.

17 Claims, 3 Drawing Sheets

U.S. PATENT DOCUMENTS

| | | | | | |
|---|---|---|---|---|---|
| 3,366,011 | A | | 1/1968 | Sturtevant | |
| 3,491,473 | A | * | 1/1970 | Eastin | 42/74 |
| 3,618,248 | A | | 11/1971 | Into et al. | |
| 3,754,344 | A | | 8/1973 | Spiliotis | |
| 3,805,668 | A | * | 4/1974 | Zellweger et al. | 89/177 |
| 3,977,296 | A | | 8/1976 | Silsby et al. | |
| 4,164,825 | A | | 8/1979 | Hutchison | |
| 4,307,653 | A | | 12/1981 | Goes et al. | |
| 4,335,644 | A | * | 6/1982 | Goes et al. | 89/198 |
| 4,512,101 | A | | 4/1985 | Waterman, Jr. | |
| H217 | H | | 2/1987 | Jorczak | |
| 4,875,402 | A | * | 10/1989 | Metz | 89/43.01 |
| 4,945,666 | A | * | 8/1990 | Henry et al. | 42/1.06 |
| 5,410,833 | A | | 5/1995 | Paterson | |
| 5,598,904 | A | | 2/1997 | Spyche, Jr. | |
| 5,722,195 | A | | 3/1998 | Bentley et al. | |
| 5,888,214 | A | | 3/1999 | Ochoa | |
| 6,564,493 | B1 | | 5/2003 | Forman et al. | |
| 6,662,485 | B2 | | 12/2003 | Kay | |
| 6,848,351 | B1 | * | 2/2005 | Davies | 89/191.01 |
| 6,901,691 | B1 | | 6/2005 | Little | |
| 7,131,367 | B1 | * | 11/2006 | Boerschig et al. | 89/198 |
| 7,213,498 | B1 | * | 5/2007 | Davies | 89/198 |

OTHER PUBLICATIONS

SpecOps Stock, Knoxx Industries, LLC, 2 pgs.
COPstock Folder, Knoxx Industries, LLC, 3 pgs.

* cited by examiner

HYDRAULIC RECOIL BUFFER ASSEMBLY

FIELD OF THE INVENTION

This invention relates generally to recoil energy absorption in firearms and, more particularly, to a hydraulic recoil buffer assembly for use between the stock and the receiver or pistol grip of a shotgun or rifle or other shoulder-held firearm to dissipate the recoil energy associated with discharge of the firearm.

BACKGROUND OF THE INVENTION

When a shoulder-held firearm is discharged, a rearwardly directed recoil force is generated as a result of the force impulse created to accelerate the ammunition. This recoil imparts a load on the shoulder of the shooter which is not only uncomfortable, but over repeated firings can lead to fatigue of the shooter. Various energy absorption devices have heretofore been used in connection with firearms to dissipate the recoil energy produced upon discharge of the firearm. In one class of energy absorption devices heretofore proposed for use in reducing recoil impact, a recoil assembly is disposed in the firearm stock rearwardly of the bolt and carrier assembly.

For example, U.S. Pat. No. 3,977,296 discloses a hydraulic buffer assembly in a fixed stock automatic or semiautomatic firearm for providing a reduced rate of fire and a mild recoil shock reduction. The disclosed hydraulic buffer assembly is axially translatable within the receiver extension tube and includes a piston and a pair of fluid-filled chambers interconnected by a fixed orifice passage. The receiver extension tube is threaded at its forward end into the gun receiver, extends rearwardly in a cavity in the stock of the firearm and is secured at its aft end to the butt end of the stock. The hydraulic buffer assembly is in coaxial alignment with the bolt and carrier assembly with the rearward end of the bolt and carrier assembly contacting the forward end of the piston of the hydraulic buffer assembly. In operation, when the firearm is discharged, the expanding gases drive the bolt and carrier assembly and the buffer rearwardly in unison against a first coil spring disposed within the buffer assembly. The bolt and carrier assembly also drives the buffer assembly rearward against a second coil spring disposed about the exterior of the buffer assembly until the rearward end of the buffer strikes the butt end wall of the receiver extension tube. Hydraulic resistance commences as soon as the piston is displaced as fluid passes from one chamber to the other chamber through the fixed orifice passage. These hydraulic buffer assemblies are only useable in weapons that allow the bolt and carrier assembly to move within the receiver extension tube.

U.S. Pat. No. 4,164,825 discloses a device for reducing firearm recoil on a shoulder-fired firearm wherein the recoil energy absorption device is mounted within a fixed gun stock. The device disclosed therein includes a tubular case defining an elongated interior chamber filled with a viscous liquid and housing a vaned piston disposed between a reset spring and a reset damper spring. The device is inserted in an elongated cavity drilled in the gun stock and extending substantially parallel to the gun barrel. When the firearm is fired, the recoil energy is dampened as the case and liquid therein are driven rearwardly against the resistance of the piston.

U.S. Pat. No. 5,410,833 discloses a recoil absorbing firearm stock utilizing a stacked arrangement of cupped-discs to decrease the impact force felt by the individual firing a shoulder-fired firearm. The disclosed recoil absorbing stock includes a buttstock and a stock grip interconnected by a telescoping stabilizing strut and an adjustable length recoil absorbing strut disposed in parallel. The recoil absorbing strut includes a plurality of compressible, cupped-disc springs arranged in nested sets and mounted on a guide rod for absorbing the recoil energy produced upon discharge of the firearm. The compressive preload on the stack of nested sets of cupped-disc springs may be adjusted by turning a tensioning screw.

A collapsible buttstock for use on shoulder-held firearms having a built-in recoil shock absorber is commercially available under the product name "Stock Shox". The recoil shock absorber inside the buttstock includes a compression-rebound unit of the type disclosed in U.S. Pat. No. 5,888,214. The compression-rebound unit includes a housing, a cylindrical resilient elastomeric body mounted in the housing for compression and post-compression expansion, and a displacement member extending into the housing. In response to recoil generated upon discharge of the firearm, the displacement member moves rearward within the housing compressing the resilient elastomeric body. Upon completion of the rearward stroke, the elastomeric body expands and returns the displacement member to its original position.

SUMMARY OF THE INVENTION

It is an object of the invention to provide a recoil buffer assembly for a firearm having a fixed or collapsible stock that provides a hydraulic resistance to recoil.

It is an object of an aspect of the invention to provide a recoil buffer assembly for a firearm having a fixed or collapsible stock that provides an adjustable hydraulic resistance to recoil.

It is an object of an aspect of the invention to provide a recoil buffer assembly for a firearm having a fixed or collapsible stock that provides both a mechanical resistance and a hydraulic resistance to recoil.

The invention provides a hydraulic recoil buffer assembly for a firearm having a fixed or collapsible stock assembly. The recoil buffer assembly includes an end cylinder having a forward end adapted for securing to the receiver or pistol grip assembly of the firearm, a hydraulic shock absorption assembly operatively associated with the end cylinder to produce a hydraulic resistance to a rearward movement of the end cylinder during recoil of the firearm, and at least one spring to provide preload and return the recoil buffer to a battery position. The aft end of the end cylinder is disposed within the axially extending cavity of the extension tube of the stock assembly and is slidably translatable with respect to the extension tube. The orifice restricted fluid flow passage may include at least one fixed flow area orifice or at least one adjustable flow area orifice. In an embodiment, the hydraulic shock absorption assembly has a fixed volume fluid chamber, a variable volume fluid chamber, and an orifice restricted fluid flow passage connecting the variable volume fluid chamber in fluid flow communication with the fixed volume fluid chamber.

In an embodiment of the hydraulic recoil buffer of the invention, the hydraulic shock absorption assembly further includes a shock tube having a closed end and an open end and defining an axially extending cavity, an axially extending piston rod having a proximal end and a distal end, and a piston head associated with the proximal end of the piston rod. The piston head is received within the open end of the shock tube and is axially translatable within the cavity of the shock tube. The space within the cavity of the shock tube between the closed end of the shock tube and the piston head defines a variable volume fluid chamber. A return coil spring is disposed within the cavity of the shock tube and extends between the closed end of the shock tube and the piston head. A retaining body is disposed about the piston rod and has a central axially extending bore through which the piston rod translates. The retaining body includes a cavity defining a fixed volume chamber. A recoil coil spring is disposed about the piston rod and is operatively associated with the end cylinder to resist rearward movement of the end cylinder. The hydraulic shock absorption assembly may be disposed in the cavity of the extension tube of the stock assembly with the shock tube positioned in a rearward portion of the cavity of the extension tube and the distal end of the piston rod connected to the aft end of the end cylinder, or with the shock tube received in an axially elongated cavity within the end cylinder and the distal end of the piston rod connected to an end plug body disposed within a rearward portion of the cavity of the extension tube.

BRIEF DESCRIPTION OF THE DRAWINGS

For a further understanding of the invention, reference will be made to the following detailed description of the invention which is to be read in connection with the accompanying drawing, where.

DETAILED DESCRIPTION OF THE INVENTION

Figure 1:
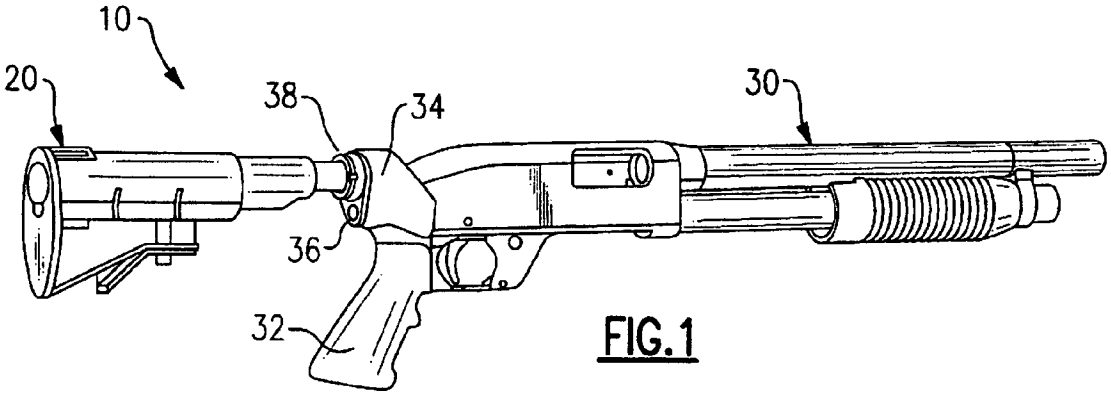
FIG. 1 is a side elevation view of an exemplary embodiment of a collapsible stock shoulder-held firearm equipped with a hydraulic buffer assembly in accordance with the invention.
Figure 2:
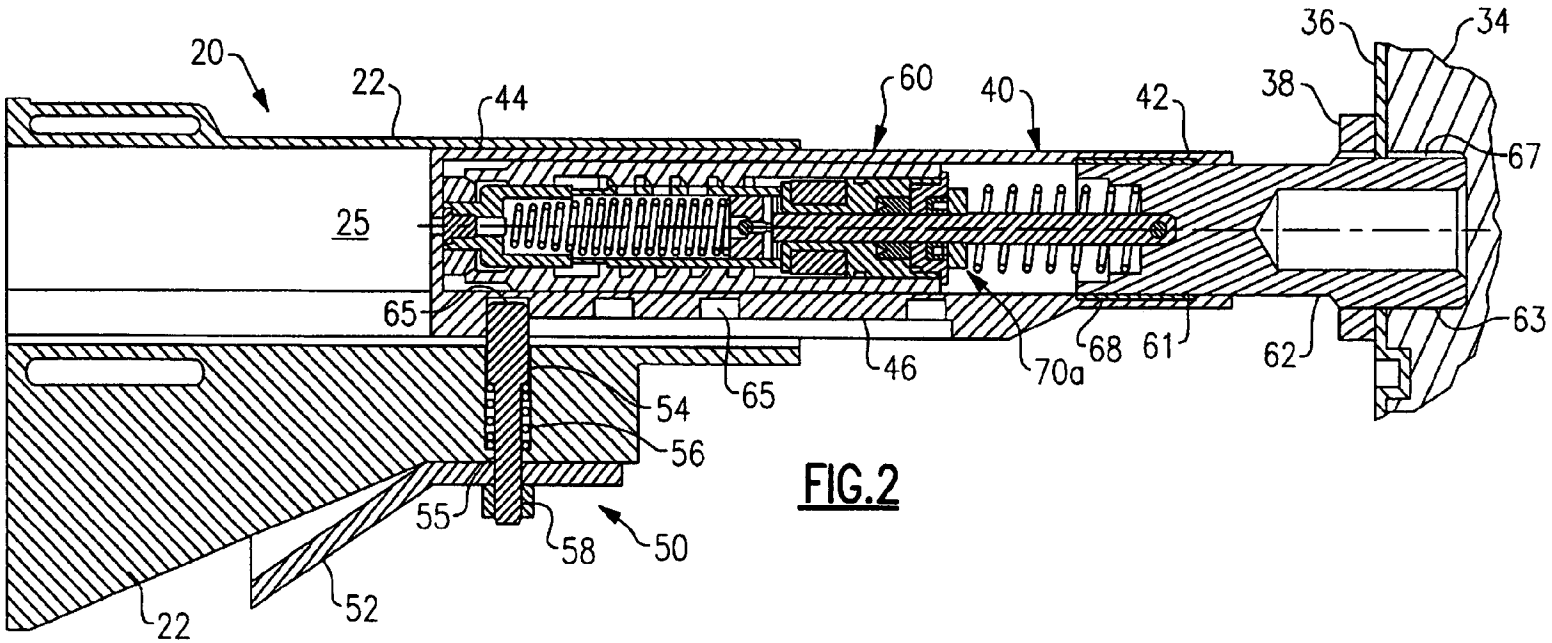
FIG. 2 is an elevation view, in section, of the portion of the firearm of FIG. 1 aft of the receiver.

Referring now to FIGS. 1 and 2, there is depicted a tactical shotgun 10 having a collapsible stock assembly 20, a gun barrel 30 having a pistol grip 32 and a stock and pistol grip adaptor 34, and a hydraulic recoil buffer assembly 60 providing an interface between the collapsible stock assembly 20 and the stock and pistol grip adaptor 34. The collapsible stock assembly 20 includes an axially elongated extension tube 40 having an open forward end 42 and an aft end 44 that is slidably received into an axially extending cavity 25 in the buttstock 22 of the collapsible stock assembly 20. The cavity 25 extends coaxially with the extension tube 40 for the length of the buttstock 22. The hydraulic recoil buffer assembly 60 includes an end cylinder 62 having an aft end 61 disposed coaxially within forward end 42 of the extension tube 40 and a forward end 63 extending coaxially outward from the extension tube 40. The forward end 63 of the end cylinder 62 is provided with threads and is threaded into a socket in the stock and pistol grip adaptor 34 that is generally coaxially aligned with the firing mechanism in the gun barrel 30. The forward end 63 of the end cylinder 62 also includes an axially extending slot 67 which is engaged by the receiver end plate 36 to prevent rotation of the end cylinder 62 relative to the pistol grip adaptor 34. The end cylinder 62 is retained against the receiver end plate 36 by the locknut 38. The buttstock 22 and extension tube 40 assembly is prevented from rotating about the shaft of the end cylinder 62 by means of a bearing 68 having a generally D-shaped bore for receiving the shaft of the end cylinder 62 which is corresponding generally D-shaped. A bearing 68 is secured in the extension tube 40 such as to prevent rotation of the bearing 68 with respect to the extension tube 40.

In addition to the aforementioned buttstock 22 and extension tube 40, the collapsible stock assembly 20 includes an adjustment mechanism 50 operatively associated with the buttstock 22 and the extension tube 40 whereby the overall length of the buttstock assembly 20 may be adjusted in a manner known in the art to accommodate different users. The adjustment mechanism 50 includes an adjustment lever 52, locking pin 54, locking spring 56 and locknut 58. The locking pin 54 is positioned in and extends through a bore that extends vertically upwardly through a forward portion of the buttstock 22. The locking spring 56 is a coil spring disposed about the locking pin 54 and extending between a shoulder 55 of the locking pin 54 and the adjustment lever 52 which is mounted on the lower end of the locking pin 54 and secured thereto by the locknut 58. A more detailed discussion of an adjustable buttstock assembly of this type is presented in U.S. Pat. No. 3,348,328.

An elongated groove 46 extends axially along the bottom surface of the aft portion of the extension tube 40. The elongated groove 46 has a plurality of indents 65 provided therein at axially spaced intervals along the length of the groove 46. To mount the buttstock 22 to the aft end 44 of the extension tube 40, the adjustment lever 52 is depressed, thereby pulling locking pin 54 back in the bore against the locking spring 56, and the buttstock 22 is slid over the aft end 44 of the extension tube 40 to a desired one of the locations commensurate with the bore aligning with one of the plurality of indents 65 in the groove 46. With the buttstock 22 so positioned, the adjustment lever 52 is released and the coil spring 56 will expand and drive the locking pin 54 into the indent 65 mating with the bore, thereby locking the buttstock 22 onto the extension tube 40.

Figure 4:
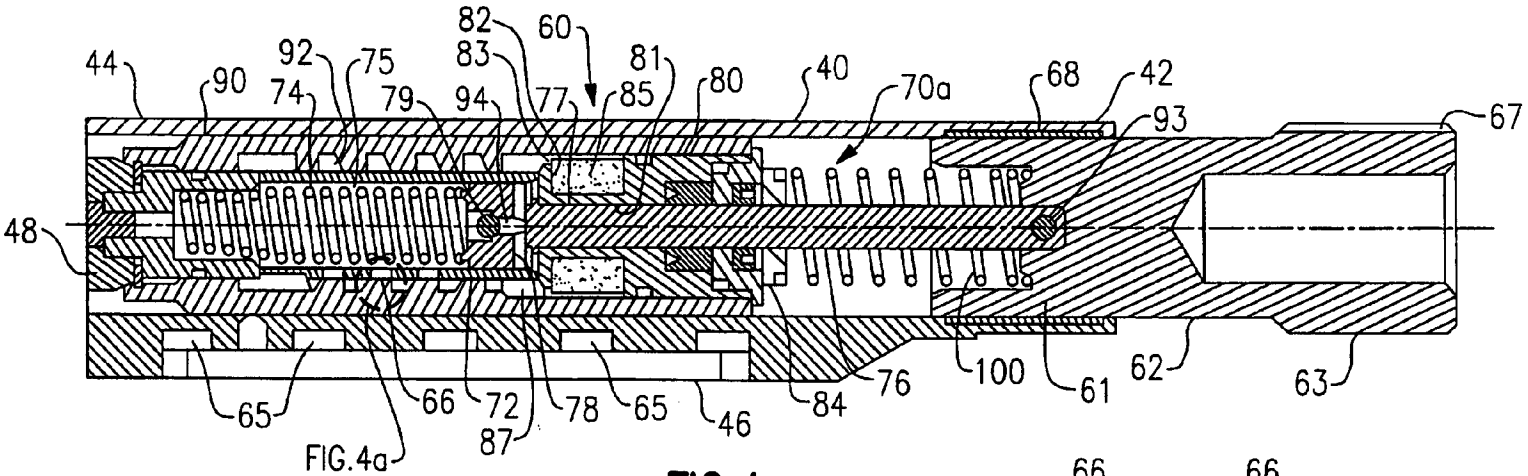
FIG. 4 is an elevation view, in section, of the exemplary embodiment of the hydraulic recoil buffer assembly shown in FIG. 2.
Figure 4A:
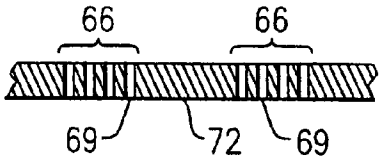
FIG. 4*a* is an exploded elevation view, in section, of a portion of the hydraulic recoil buffer assembly of FIG. 4.

The hydraulic recoil buffer assembly 60, which couples the collapsible stock assembly 20 to the stock and pistol grip adaptor 34 as discussed hereinbefore, provides a recoil buffer to dissipate the recoil energy generated upon discharge of the firearm. The recoil buffer assembly 60 further includes a hydraulic shock absorption assembly, generally referenced 70*a*, that is disposed within or integral to the extension tube 40 in operative association with the end cylinder 62. As best seen in FIG. 4, the shock absorption assembly 70*a* includes a shock tube 72, a coil spring 74, an axially elongated piston rod 76, a piston head 78 and a retaining body 80. The shock tube 72 is a cylindrical tube having a closed end and an open end and defines an elongated interior volume therebetween. The piston head 78 is disposed within the interior volume and is in contact with the proximal end 77 of the piston rod 76 which extends to the open end of the shock tube 72. The portion of the interior volume between the end face of the shock tube 72 at its closed end and the face of the piston head 78 defines a variable volume collapsible cavity or fluid chamber 75. The coil spring 74 is disposed within this variable volume fluid chamber 75 so as to bias the piston head 78 away from the end face of the closed end of the shock tube 72.

The hydraulic shock absorption assembly 70*a* is coaxially disposed within an outer cylindrical sleeve 90 with the retaining body 80 stationarily mounted to the outer sleeve 90. The retaining body 80 is disposed about the piston rod 76 which passes through an axially extending bore 81 in the retaining body 80 for slidable movement with respect thereto. The retaining body 80 includes an annular groove 82 which in cooperative association with the inner wall of the surrounding outer sleeve 90 defines a fixed volume fluid chamber 85. The fluid chamber 85 has an annular inlet 83 open to an annular cavity 87 formed between the outer surface of the shock tube 72 and the inner surface of the outer sleeve 90. A piece of closed cell foam material is disposed within the annular groove 82. The foam, which is compressed when fluid is forced into the fluid chamber 85, forces the fluid out of the fixed volume chamber 85 as the piston rod extends.

Figure 3:
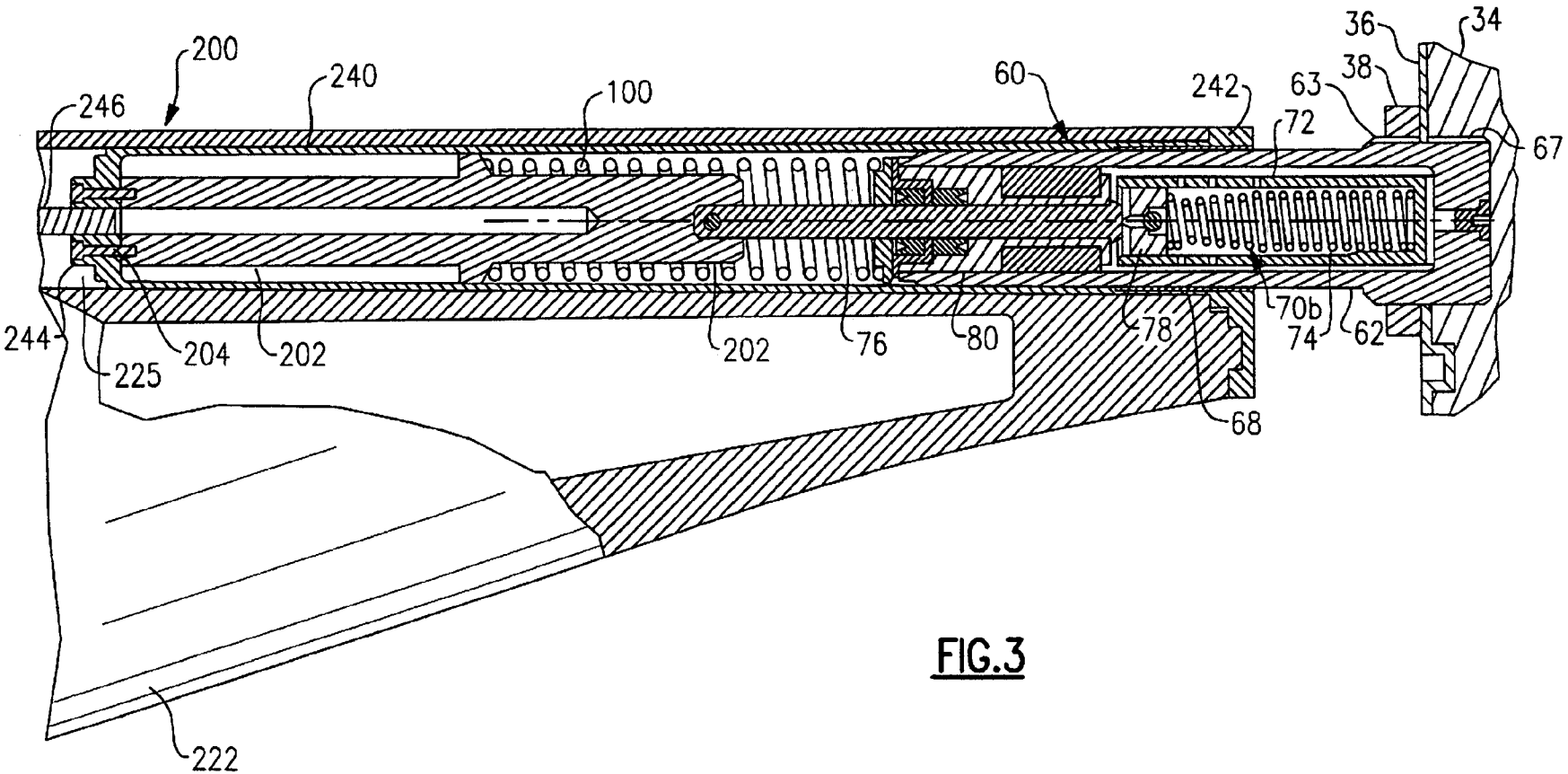
FIG. 3 is an elevation view, partly in section, of the stock portion of a fixed stock firearm equipped with a hydraulic buffer assembly in accordance with the invention.

Referring now to FIG. 3, there is depicted the aft portion of a tactical firearm equipped with a fixed stock 200, rather than a collapsible stock, having a recoil buffer assembly 60 providing an interface between the fixed stock 200 and the pistol grip adaptor 34. The fixed stock 200 includes an axially elongated cylindrical tube 240 having an open forward end 242 and a closed aft end 244 that is received into an axially extending cavity 225 in the buttstock 222 of the fixed stock 200. The tube 240 is secured at its aft end 244 to the aft end of the buttstock 222, for example by means of a threaded fastener such as bolt 246. The hydraulic buffer assembly 60 is coaxially disposed within the cylindrical tube 240 with its end cylinder 62 extending axially outwardly through the open forward end 242 of the tube 240. The forward end portion 63 of the end cylinder 62 is provided with external threads and is threaded into an internally threaded socket in the pistol grip adaptor 34 that is generally coaxially aligned with the firing mechanism in the gun barrel (not shown). The forward end 63 of the end cylinder 62 also includes an axially extending slot 67 which is engaged by the receiver end plate 36 to prevent rotation of the end cylinder 62 relative to the pistol grip adaptor 34. The end cylinder 62 is retained against the receiver end plate 36 by the locknut 38. The buttstock 222 and cylindrical tube 240 assembly is prevented from rotating about the shaft of the end cylinder 62 by means of a bearing 68 having a generally D-shaped bore for receiving the shaft of the end cylinder 62 which is corresponding generally D-shaped. A bearing 68 is secured in the cylindrical tube 240 such as to prevent rotation of the bearing 68 with respect to the cylindrical tube 240.

Figure 5:
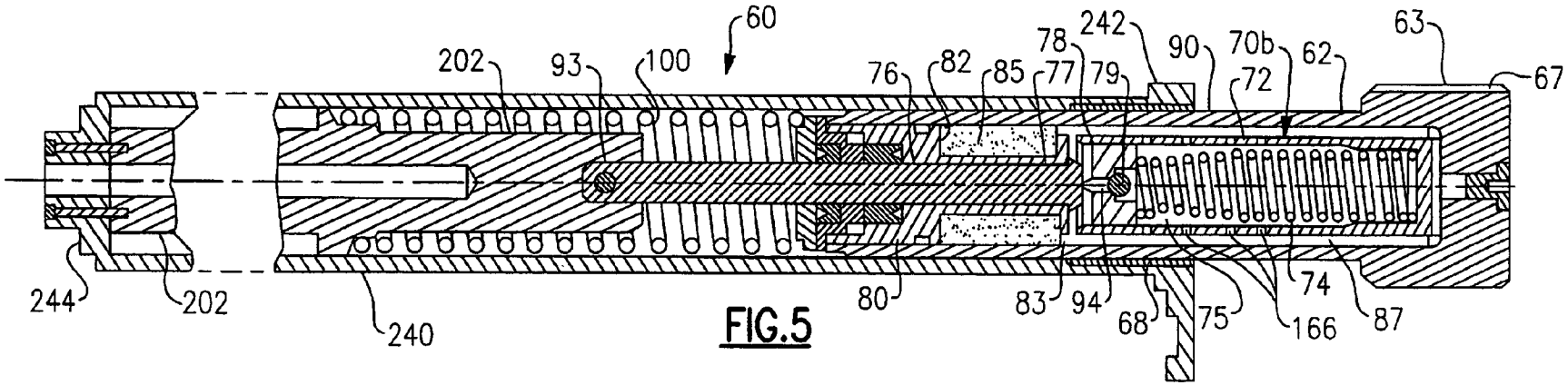
FIG. 5 is an elevation view, in section, of the exemplary embodiment of the hydraulic recoil buffer assembly shown in FIG. 3.

In the fixed stock embodiment, the hydraulic recoil buffer assembly couples the fixed stock 200 to the pistol grip adaptor 34, as well as providing a recoil buffer to dissipate the recoil energy generated upon discharge of the firearm. The recoil buffer assembly 60 further includes a hydraulic shock absorption assembly, generally referenced **70*b* that includes a shock tube 72, a coil spring 74, an axially elongated piston rod 76, a piston head 78 and a retaining body 80, as illustrated in FIG. 5. The forward end of the end plug body 202, which is disposed coaxially within the tube 240, is connected to the aft end of the piston rod 76. The piston head 78 is disposed within the aft end of the shock tube 72. The aft end of the end plug body 202 is secured to the aft end 244 of the tube 240 by means of threaded fasteners, such as machine bolts 204**.

In the exemplary embodiment of the hydraulic recoil buffer assembly 60 depicted in FIG. 4, the distal end 93 of the piston rod 76 is connected to the aft end 61 of the end cylinder 62. A return coil spring 100 is disposed coaxially about and extends along the distal end 93 of the piston rod 76 between a first spring seat on the end face 84 of the retaining body 80 and a second spring seat on the aft end 61 of the end cylinder 62. Thus, in this embodiment, the hydraulic shock absorption assembly **70*a* is disposed aft of the retaining body 80 with the piston rod 76 extending forwardly along the axis of the recoil buffer assembly 60 to connect to the end cylinder 62 which is threaded at its forward end 63 into the stock and pistol grip adaptor 34. However, in the exemplary embodiment of the hydraulic recoil buffer assembly depicted in FIG. 5, the hydraulic shock absorption assembly 70*b* is disposed forward of the retaining body 80 with the piston rod 76 extending rearward along the axis of the recoil buffer assembly 60 to connect to the forward end of the end plug body 202 disposed coaxially within the aft end 244 of the cylindrical tube 240. In this embodiment, the return coil spring 100 is also disposed coaxially about and extends along the distal end of the piston rod 76 and about the end plug body 202 between a first spring seat on the end face of the retaining body 80 and a second spring seat formed on the end plug body 202**.

Referring now to FIGS. 4 and **4*a*, in the embodiment of the hydraulic shock absorption assembly 70*a* depicted therein, a series of axially spaced orifice sets 66 are provided in the wall of the shock tube 72. Each orifice set 66 is formed of a plurality of axially adjacent, radially extending holes 69 drilled through the wall of the shock tube 72. Additionally, a spiral groove 92 is cut in the inner wall of the outer cylindrical sleeve 90, thereby also forming a corresponding land segment, within which the shock tube 72 is coaxially disposed. The spiral groove 92 is in fluid flow communication with the chamber 85 in the retaining body 80. The variable volume fluid chamber 75 is also connected in fluid flow communication with the chamber 85 through a central passage 94 passing axially through the piston head 78. A valve ball 79 disposed within a hollow in the piston head at the mouth to the central passage 94 prevents flow of fluid from the chamber 75 into the chamber 85 when fluid is flowing from the chamber 75 through the orifice holes 69 and into the spiral groove 92 into the chamber 85 and behind the piston head 78. Advantageously, the hydraulic shock absorption assembly 70*a* depicted in FIG. 4** may be the adjustable energy absorption device described in U.S. Pat. No. 5,598,904, the entire disclosure of which is incorporated herein by reference.

By adjustment of the adjustment knob 48, the shock tube 72 is selectively axially positionable relative to the outer cylindrical sleeve 90 so to align one or more holes 69 of each orifice set 66 with the spiral groove 92, as desired, with the remaining holes 69 aligned with the land segment and therefore closed to flow. Each of the orifice holes 69 aligned with the spiral groove 92 provides a passage connecting the chamber 75 within the shock tube 72 in fluid flow communication with the spiral groove 92 thereby connecting the chamber 75 within the shock tube 72 in fluid flow communication with the chamber 85. The hydraulic resistance developed by the hydraulic shock absorption assembly **70*a* is directly proportional to the number of orifice holes 69 that open for fluid to flow from the variable volume fluid chamber 75 into the fixed volume chamber 85 and behind the piston head 78. As noted previously, the closed cell foam within the fixed volume chamber 85 is compressed as the fluid flows into the fixed volume chamber 85. The amount of fluid equal to the displaced piston rod volume is the only volume of fluid that goes into the fixed volume chamber 85. Additional fluid is also allowed to flow into the region of the shock tube 72 behind the piston head 78 when the piston rod 76 is being compressed during recoil. By selectively axially positioning the shock tube 72 relative to the outer cylindrical sleeve 90**, the hydraulic resistance may be adjusted to accommodate a different caliber of ammunition.

Upon discharge of a fixed or collapsible stock firearm equipped with the embodiment of the hydraulic recoil buffer assembly 60 of the invention depicted in FIG. 4, the end cylinder 62 is driven rearward by the recoil force. As the end cylinder 62 translates axially rearward it compresses the coil spring 100 disposed about the piston rod 76 as it drives the piston rod 76 and the piston head 78 axially rearward. As the piston head 78 moves rearward within the shock tube 72, it compresses the coil spring 74 thereby decreasing the volume of the variable volume fluid chamber 75 and forcing fluid within the chamber 75 through the orifice holes 69 aligned with the spiral groove 92 into and through the spiral groove 92 into the fixed volume fluid chamber 85 within the retaining body 80, and around the back of the shock tube 72 to fill in behind the piston head 78. The rearward travel of the end cylinder 62 from the battery position to the recoil position is limited by the distance to the forward end face of the stationary retaining body 80. The distance of travel defines the recoil stroke, generally about one inch.

Upon dissipation of the recoil energy, the piston head 78 and the end cylinder 62 are driven forwardly to return to the battery position by the expansion of the compressed coil springs 74 and 100. Additionally, as the piston head moves forwardly, the fluid pressure within the chamber 75 decreases as the volume of chamber 75 increases thereby causing the valve ball 79 to move rearward to open the central passage 94 so that fluid may pass from the fixed volume chamber 85 and behind the piston head 78 to return to the variable volume fluid chamber 75. The closed cell foam material in the fluid chamber 85 expands thereby forcing fluid out of the chamber 85 as the piston rod extends Referring now to FIG. 5, in the embodiment of the hydraulic shock absorption assembly 70*b* depicted therein, a series of axially spaced orifices 166 are provided in the wall of the shock tube 72. Each orifice 166 is a single radially extending hole drilled through the wall of the shock tube 72. Each orifice hole 166 provides a fixed flow area. As in the FIG. 4 embodiment, the chamber 75 is also connected in fluid flow communication with the chamber 85 through a central passage 94 passing axially through the piston head 78. The valve ball 79 disposed within a hollow in the piston head at the mouth to the central passage 94 prevents flow of fluid from the chamber 75 into chamber 85 when fluid is flowing from the chamber 75 through the orifice holes 166 into the chamber 85 and behind the piston head 78.

Upon discharge of a fixed or collapsible stock firearm equipped with the embodiment of the hydraulic recoil buffer assembly 60 of the invention depicted in FIG. 5, the end cylinder 62 is driven rearward by the recoil force. As the end cylinder 62 translates axially rearward it both compresses the coil spring 100 disposed about the end plug body 202 and also drives the shock tube 72 axially rearward. As the shock tube 72 moves rearward it slides over the piston head 78 at the forward end of the piston rod 76 and along the axially extending, but in this embodiment stationary, piston rod 76. As the shock tube 72 moves rearward relative to the piston head 78, the piston head compresses the coil spring 74 thereby decreasing the volume of the variable volume fluid chamber 75 and forcing fluid within the chamber 75 through the orifice holes 166 and through the annular cavity 87 around the outside of the shock tube 72 into the fixed volume chamber 85 within the retaining body 80, and also around the back of the shock tube 72 to fill in behind the piston head 78. The rearward travel of the end cylinder 62 from the battery position to the recoil position is limited by the distance to the forward end face of the stationary end plug body 202. The distance of travel defines the recoil stroke, again generally about one inch, and is the distance through which the shock tube 72 travels during recoil.

Upon dissipation of the recoil energy, the end cylinder 62 is driven forwardly to return to the battery position by the expansion of the compressed recoil spring 100. Additionally, as the end cylinder 62 moves forwardly, the coil spring 74 expands driving the shock tube 72 forwardly in unison with the end cylinder 62. Simultaneously, fluid pressure within the chamber 75 within the shock tube 72 decreases as the volume of the chamber 75 increases thereby causing the valve ball 79 to move forward to open the central passage 94 so that fluid may pass from the fixed volume chamber 85 and behind the piston head 78 to return to the variable volume fluid chamber 75.

The hydraulic recoil buffer assembly 60 of the invention provides three actions for absorbing the recoil energy generated by discharge of a firearm equipped therewith: the compression of the recoil spring 100, the compression of the return spring 74, and the movement of fluid from the chamber 75 through the orifice holes into the chamber 85. The overall recoil resistance of the hydraulic buffer 60 is determined by the mechanical spring characteristics of coil springs selected for each of the return spring 74 and the recoil spring 100 and the hydraulic resistance characteristic of the orifice restrictions in the shock tube 72. In the FIG. 4 embodiment, the overall hydraulic resistance of the hydraulic recoil buffer assembly 60 may be adjusted as previously mentioned, for example to accommodate a different caliber ammunition, to selectively increase or decrease the number of holes 69 in flow communication with the spiral groove 92 thereby increasing or decreasing the overall flow resistance generated. In the FIG. 5 embodiment, however, the hydraulic resistance of the hydraulic recoil buffer assembly 60 is not adjustable, but rather is fixed upon design by the flow area of the fixed area orifice holes 166.

While the present invention has been particularly shown and described with reference to the preferred mode as illustrated in the drawing, it will be understood by one skilled in the art that various changes in detail may be effected therein without departing from the spirit and scope of the invention as defined by the

We claim:

1. A recoil buffer assembly for a firearm including a receiver or pistol grip assembly and a stock assembly said recoil buffer assembly comprising:

an extension tube mounted within said stock assembly, an end cylinder having a forward end removably attached to said receiver or pistol grip assembly of said firearm and an aft end slidably translatable within said extension tube to establish a collapsible cavity, a hydraulic shock absorption assembly housed within said collapsible cavity and having an orifice restricted flow passage such that said hydraulic absorption assembly produces a hydraulic resistance to a rearward movement of said end cylinder within said collapsible cavity, and at least one spring to provide preload and return the recoil buffer assembly to a battery position.

2. A recoil buffer assembly for a firearm as recited in claim 1 wherein the orifice restricted fluid flow passage of said hydraulic shock absorption assembly includes at least one fixed flow area orifice.

3. A recoil buffer assembly for a firearm as recited in claim 1 wherein the orifice restricted fluid flow passage of said hydraulic shock absorption assembly includes at least one adjustable flow area orifice.

4. The recoil buffer assembly of claim 1 that further includes a bearing means for slidably connecting said end cylinder and said extension tube.

5. A recoil buffer assembly for a firearm including a receiver or pistol grip assembly and a stock assembly said recoil buffer assembly comprising:

an extension tube mounted in said stock assembly, an end cylinder having a forward end removably attached to the receiver or pistol grip assembly of said firearm and an aft end slidably translatable within said extension tube to establish an enclosed collapsible cavity, a hydraulic shock absorption assembly housed within said collapsible cavity and having a fixed volume fluid chamber, a variable volume fluid chamber and an orifice restricted fluid flow passage connecting said variable volume fluid chamber in fluid flow communication with said fixed volume fluid chamber such that said hydraulic shock absorption assembly coacts with said end cylinder to produce a hydraulic resistance to a rearward movement of said end cylinder within said extension tube, and at least one spring to provide preload and return the recoil buffer assembly to a battery position.

6. A recoil buffer assembly for a firearm as recited in claim 5 wherein said hydraulic shock absorption assembly is disposed in the cavity of said extension tube with a shock tube received in an axially elongated cavity within said end cylinder and a distal end of a piston rod is connected to or in contact with an end plug body disposed within a rearward portion of the cavity of said extension tube.

7. A recoil buffer assembly for a firearm as recited in claim 6 wherein the orifice restricted fluid flow passage of said hydraulic shock absorption assembly includes at least one fixed flow orifice.

8. The recoil buffer of claim 5 that further contains a bearing means for slidably connecting said end cylinder and said extension tube.

9. A recoil buffer assembly for a firearm including a receiver or pistol grip assembly and a stock assembly, said recoil buffer assembly comprising:

an extension tube mounted within said stock assembly, an end cylinder having a forward end removably attached to said receiver or pistol grip assembly of said firearm and an aft end slidably translatable within said extension tube, a hydraulic shock absorption assembly housed within said extension tube and said aft end of said end cylinder having an orifice restricted fluid flow passage, said hydraulic shock absorption assembly operatively associated with said end cylinder to produce a hydraulic resistance to a rearward movement of said end cylinder, and wherein said hydraulic shock absorption assembly further includes:

a shock tube having a closed end and an open end defining an axially extending cavity, an axially extending piston rod having a proximal end, a distal end, and a piston head associated with the proximal end of the piston rod, said piston head received within the open end of said shock tube and being axially translatable within the cavity of said shock tube, the space within the cavity of said shock tube between the closed end of said shock tube and said piston head defining a variable volume fluid chamber;

a return coil spring disposed within the cavity of said shock tube and extending between the closed end of said shock tube and said piston head;

a retaining body disposed about said piston rod and having a central axially extending bore through which said piston rod translates, said retaining body having a groove formed defining a fixed volume chamber; and a recoil spring disposed about said piston rod and operatively associated with said end cylinder to resist rearward movement of said end cylinder.

10. A recoil buffer assembly for a firearm as recited in claim 9 wherein said hydraulic shock absorption assembly is disposed in the cavity of said extension tube with said shock tube positioned in a rearward portion of the cavity of said extension tube and the distal end of said piston rod connected to or in contact with the aft end of said end cylinder.

11. A recoil buffer assembly for a firearm as recited in claim 9 wherein said hydraulic shock absorption assembly is disposed in the cavity of said extension tube with said shock tube received in an axially elongated cavity within said end cylinder and the distal end of said piston rod is connected to or in contact with an end plug body disposed within a rearward portion of the cavity of said extension tube.

12. A recoil buffer assembly for a firearm as recited in claim 9 wherein said recoil buffer assembly is removable from said extension tube.

13. A recoil buffer assembly for a firearm as recited in claim 9 wherein said recoil buffer assembly is removable from said end cylinder.

14. A recoil buffer assembly for a firearm including a receiver or pistol grip assembly and a stock assembly said recoil buffer assembly comprising:

an extension tube mounted within said stock assembly, an end cylinder having a forward end removably attached to the receiver or pistol grip assembly of said firearm and an aft end slidably translatable within said extension tube, a hydraulic shock absorption assembly having a fixed volume fluid chamber, a variable volume fluid chamber, and an orifice restricted fluid flow passage connecting said variable volume fluid chamber in fluid flow communication with said fixed volume fluid chamber, said hydraulic shock absorption assembly operatively associated with said end cylinder to produce a hydraulic resistance to a rearward movement of said end cylinder, and wherein said hydraulic shock absorption assembly further includes:

a shock tube having a closed end and an open end defining an axially extending cavity;

an axially extending piston rod having a proximal end, a distal end, and a piston head associated with the proximal end of the piston rod, said piston head received within the open end of said shock tube and being axially translatable within the cavity of said shock tube, the space within the cavity of said shock tube between the closed end of said shock tube and said piston head defining said variable volume fluid chamber;

a return coil spring disposed within the cavity of said shock tube and extending between the closed end of said shock tube and said piston head;

a retaining body disposed about said piston rod and having a central axially extending bore through which said piston rod translates, said retaining body having a groove formed therein defining said fixed volume chamber; and a recoil coil spring disposed about said piston rod and operatively associated with said end cylinder to resist rearward movement of said end cylinder.

15. A recoil buffer assembly for a firearm as recited in claim 14 wherein said hydraulic shock absorption assembly is disposed in the cavity of said extension tube with said shock tube positioned in a rearward portion of the cavity of said extension tube and the distal end of said piston rod connected to or in contact with the aft end of said end cylinder.

16. A recoil buffer assembly for a firearm as recited in claim 15 wherein the orifice restricted fluid flow passage of said hydraulic shock absorption assembly includes at least one adjustable flow area orifice.

17. A recoil buffer assembly for a firearm including a receiver or pistol grip assembly and a stock assembly said recoil buffer assembly comprising:

an extension tube mounted within said stock assembly, an end cylinder having a forward end removably attached to said receiver or pistol grip assembly of said firearm and an aft end slidably translatable into said extension tube to establish a collapsible cavity within said extension tube, a hydraulic shock absorption assembly housed within said collapsible cavity and having an orifice restricted flow passage such that said hydraulic absorption assembly produces a hydraulic resistance to a rearward movement of said receiver or pistol grip towards said collapsible cavity, and at least one spring to provide preload and return the recoil buffer assembly to a battery position.

* * * * *